US010513904B2

(12) United States Patent
Noske, Jr. et al.

(10) Patent No.: US 10,513,904 B2
(45) Date of Patent: Dec. 24, 2019

(54) PROVISION OF INTERNAL LINES IN A WELL TOOL

(71) Applicant: WEATHERFORD TECHNOLOGY HOLDINGS, LLC, Houston, TX (US)

(72) Inventors: Joe Noske, Jr., Houston, TX (US); Christopher McDowell, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 41 days.

(21) Appl. No.: 15/638,885

(22) Filed: Jun. 30, 2017

(65) Prior Publication Data

US 2019/0003277 A1 Jan. 3, 2019

(51) Int. Cl.

| | |
|---|---|
| ***E21B 33/127*** | (2006.01) |
| ***E21B 33/128*** | (2006.01) |
| ***E21B 34/10*** | (2006.01) |
| ***E21B 34/14*** | (2006.01) |
| *E21B 34/12* | (2006.01) |

(52) U.S. Cl.

CPC ..... *E21B 33/1275* (2013.01); *E21B 33/1285* (2013.01); *E21B 34/106* (2013.01); *E21B 34/14* (2013.01); *E21B 34/12* (2013.01)

(58) Field of Classification Search

CPC ..... E21B 33/1285; E21B 33/1275

See application file for complete search history.

(56) References Cited

U.S. PATENT DOCUMENTS 3,786,863 A * 1/1974 Tausch ..... E21B 34/106 166/322

6,315,047 B1 11/2001 Deaton et al.

2007/0193735 A1* 8/2007 Farquharson ..... E21B 33/03 166/88.1

2008/0245531 A1 10/2008 Noske et al.

2008/0277119 A1 11/2008 Hill, Jr. et al.

(Continued)

FOREIGN PATENT DOCUMENTS

| | | |
|---|---|---|
| EP | 0985798 A2 | 3/2000 |
| EP | 1980711 A2 | 10/2008 |
| WO | 2006042060 A2 | 4/2006 |

OTHER PUBLICATIONS

International Search Report with Written Opinion dated Jul. 17, 2018 for PCT Patent Application No. PCT/US2018/025452, 15 pages.

*Primary Examiner* — Giovanna C Wright

*Assistant Examiner* — Dany E Akakpo

(74) *Attorney, Agent, or Firm* — Smith IP Services, P.C.

(57) ABSTRACT

A well tool can include a closure member having open and closed positions, a seat having a flow passage blocked by the closure member in the closed position, and a line extending through the seat. A communication method can include positioning a conduit in an interior of a well tool, and conducting a signal via the conduit between annular structures surrounding a longitudinal flow passage of the well tool. A well system can include a well tool connected in a tubular string, a flow passage of the tubular string extending through the well tool, the well tool including a closure member having open and closed positions, in which the closure member respectively permits and blocks flow through the flow passage, an annular cavity surrounding the flow passage, and a line, the closure member and the line being positioned in the annular cavity in the open position.

18 Claims, 8 Drawing Sheets

(56) References Cited

U.S. PATENT DOCUMENTS

| | | | |
|---|---|---|---|
| 2008/0302524 | A1 | 12/2008 | Hosie et al. |
| 2012/0325494 | A1 | 12/2012 | Noske et al. |
| 2014/0318796 | A1 | 10/2014 | Noske et al. |
| 2015/0000982 | A1 | 1/2015 | McDowell et al. |
| 2016/0281465 | A1 | 9/2016 | Grayson et al. |
| 2016/0319637 | A1 | 11/2016 | McDowell et al. |
| 2017/0089157 | A1 | 3/2017 | Noske |

* cited by examiner

PROVISION OF INTERNAL LINES IN A WELL TOOL

BACKGROUND

This disclosure relates generally to equipment utilized and operations performed in conjunction with a subterranean well and, in an example described below, more particularly includes provision of internal lines in a well tool.

It is at times desirable to be able to extend one or more lines along or past a well tool. However, cross-sectional area is very limited in a wellbore. If the lines are positioned external to the well tool, this increases the well tool's effective outer diameter. External lines can be recessed into an exterior of the well tool, but this reduces a wall thickness of the well tool.

If the lines are positioned internal to the well tool, the lines may interfere with operation of the well tool, or may restrict flow and access through the well tool. In addition, the wall thickness of the well tool may be too thin to accommodate the lines while maintaining a desired pressure and load capacity of the well tool.

Therefore, it will be appreciated that improvements are continually needed in the art of constructing and utilizing well tools with one or more lines therein. These improvements may be useful in a variety of different types of well tools and well systems.

DETAILED DESCRIPTION

Figure 1:
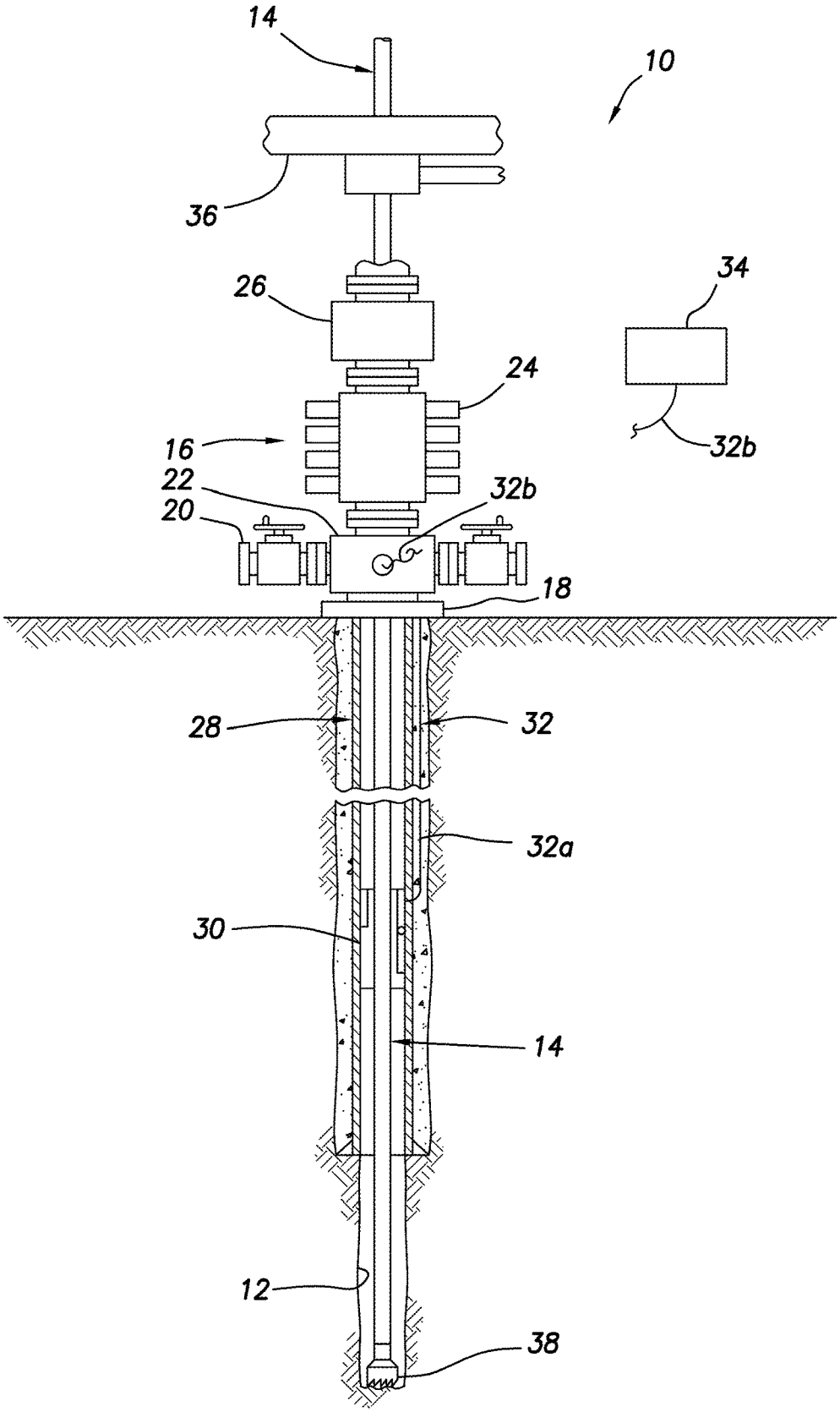
FIG. 1 is a representative partially cross-sectional view of an example of a well system and associated method which can embody principles of this disclosure.

Representatively illustrated in FIG. 1 is a well system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is being drilled by a drill string 14 extending through a wellhead assembly 16 at surface. The wellhead assembly 16 in this example includes a wellhead 18, various valves 20, various spools or housings 22, rams 24 and an annular blowout preventer 26.

However, the scope of this disclosure is not limited to use of any particular equipment or combination of equipment on or with a wellhead assembly.

Although FIG. 1 depicts a drilling operation, it is not necessary for a well to be drilled while the principles of this disclosure are practiced. For example, the well may have already been completed when the principles of this disclosure are practiced. Thus, the scope of this disclosure is not limited to drilling operations.

The drill string 14 may be rotated at surface, for example, using a top drive (not shown) or a rotary table incorporated into a rig floor 36. A drill bit 38 connected at a distal end of the drill string 14 may also, or alternatively, be rotated by use of a drill motor (not shown) connected in the drill string above the drill bit.

Note that the term "surface" is used herein to refer to locations at or near the earth's surface, whether covered by water or on dry land. Thus, a subsea wellhead assembly would be located at surface, as would a wellhead assembly suspended from a floating rig, or a wellhead assembly on dry land.

As depicted in FIG. 1, the drill string 14 extends through a casing string 28 cemented in the wellbore 12. Although only a single casing string 28 is illustrated in FIG. 1, any number of casing strings may be used. In the case of multiple casing strings, the casing string 28 may be an inner, outer or intermediate casing string.

Connected as part of the casing string 28 is a well tool 30. In this example, the well tool 30 is of the type known to those skilled in the art as a downhole deployment valve or a downhole isolation valve.

The well tool 30 functions to selectively permit and prevent fluid flow between the interior of the casing string 28 below and above the well tool. During drilling operations, a downhole deployment valve or a downhole isolation valve can be used to isolate an open hole portion of the wellbore 12 from pressures in the casing string 28 above the tool 30, and can be used to prevent flow from the open hole portion of the wellbore 12 to the casing string 28 above the tool 30.

In the FIG. 1 example, the tool 30 is cemented in the wellbore 12 with the casing string 28. In other examples, the tool 30 may be connected in another type of tubular string, may not be cemented in the wellbore 12, and/or may be retrievable from the well. Thus, the scope of this disclosure is not limited to any particular details of the tool 30 installation as depicted in FIG. 1.

The well tool 30 depicted in FIG. 1 is merely one example of a tool or item of equipment to which lines 32 may extend in a well. The lines 32 could connect to other types of tools and equipment in other examples. A sensor (not shown) could be connected to the lines 32, various types of actuators could be connected to the lines 32, etc. Therefore, the scope of this disclosure is not limited to use of any particular type, purpose, location or combination of well tools, sensors, equipment, etc., connected to the lines 32.

In FIG. 1, the lines 32 comprise downhole lines 32*a* and surface lines 32*b*. The downhole lines 32*a* are connected to the well tool 30, in this example, to communicate optical, electrical or fluid power, control, data, etc., signals between the well tool and surface. The surface lines 32*b* are connected to surface equipment 34 (such as, comprising recorders, transmission equipment, instrumentation and/or a control system for controlling operation of the well tool 30 and evaluating its performance).

The downhole lines 32*a* may be connected to multiple well tools, and/or to multiple sections of a well tool. The downhole lines 32*a* may at various locations be positioned external to, internal to, or in a wall of, the casing string 28 (or other tubular string).

Figure 2:
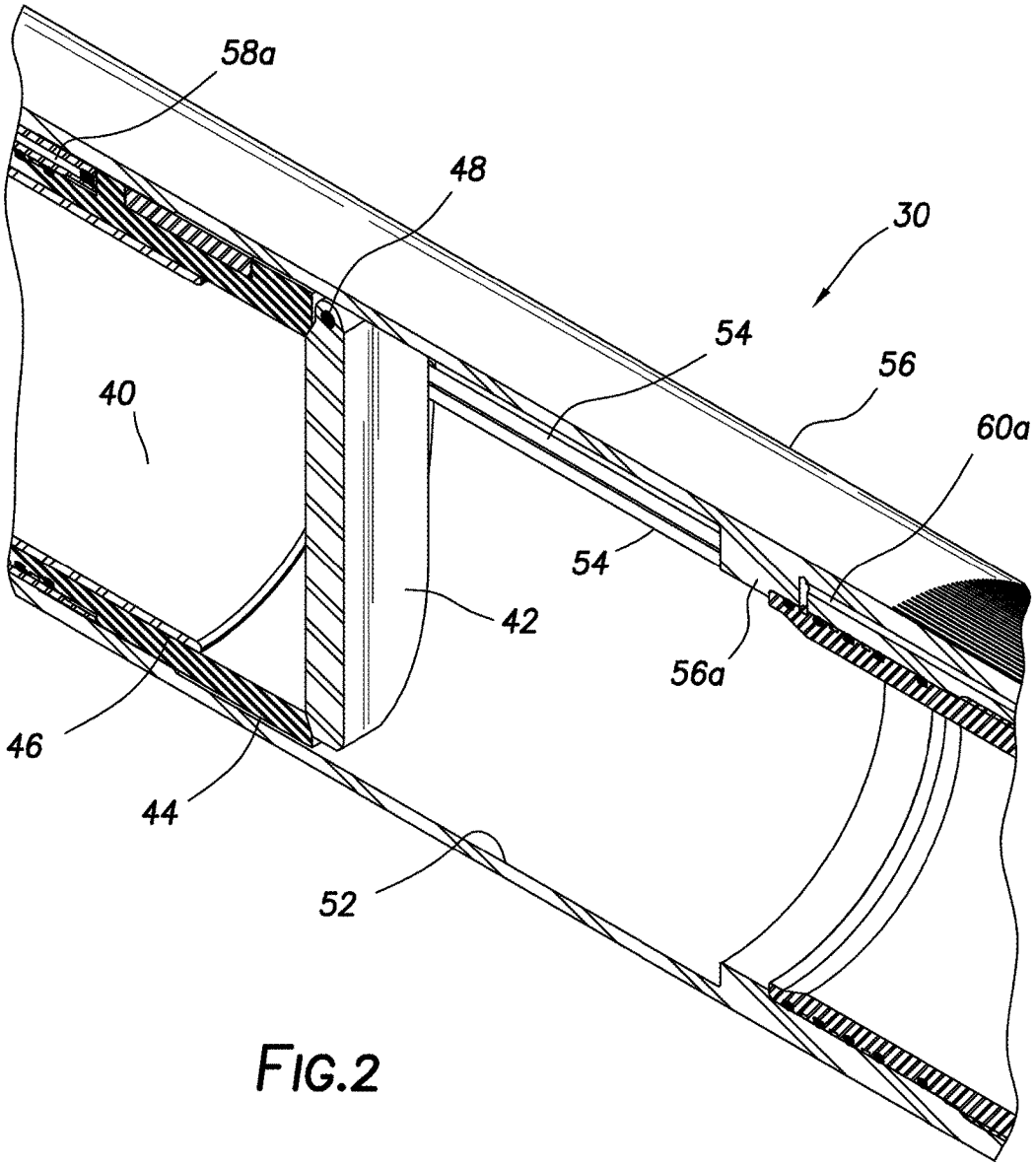
FIG. 2 is a representative isometric cross-sectional view of an example of a well tool that may be used in the system and method of FIG. 1, and which may embody the principles of this disclosure.

Referring additionally now to FIG. 2, a cross-sectional view of a portion of an example of the well tool 30 is representatively illustrated. The FIG. 2 well tool 30 may be used in the FIG. 1 well system 10 and method, or it may be used with other systems and methods.

As depicted in FIG. 2, a flow passage 40 extends longitudinally through the well tool 30. When the well tool 30 is connected in a tubular string (such as, the casing string 28 depicted in FIG. 1), the flow passage 40 also extends longitudinally through the tubular string.

A closure member 42 is pivotably mounted relative to an annular seat 44. The flow passage 40 extends through the seat 44, in that the seat outwardly surrounds the flow passage.

In this example, the closure member 42 comprises an element of the type known to those skilled in the art as a flapper. In other examples, the closure member 42 could be provided as a rotatable ball, a plug or other type of closure member.

The closure member 42 is depicted in a closed position in FIG. 2. In this position, the closure member 42 sealingly engages the seat 44 and prevents flow from a lower to an upper section of the flow passage 40. In some examples, the closure member 42 can prevent flow in both longitudinal directions through the flow passage 40 in the closed position. In an open position of the closure member 42, flow between the upper and lower sections of the flow passage 40 is permitted in both longitudinal directions.

A generally tubular operator member 46 is used to displace the closure member 42 between its open and closed positions. As depicted in FIG. 2, the operator member 46 is positioned above and spaced apart from the closure member 42 in its closed position. The closure member 42 can, thus, sealingly engage the seat 44 about an upper periphery of the closure member, and block flow through the passage 40.

Figure 6:
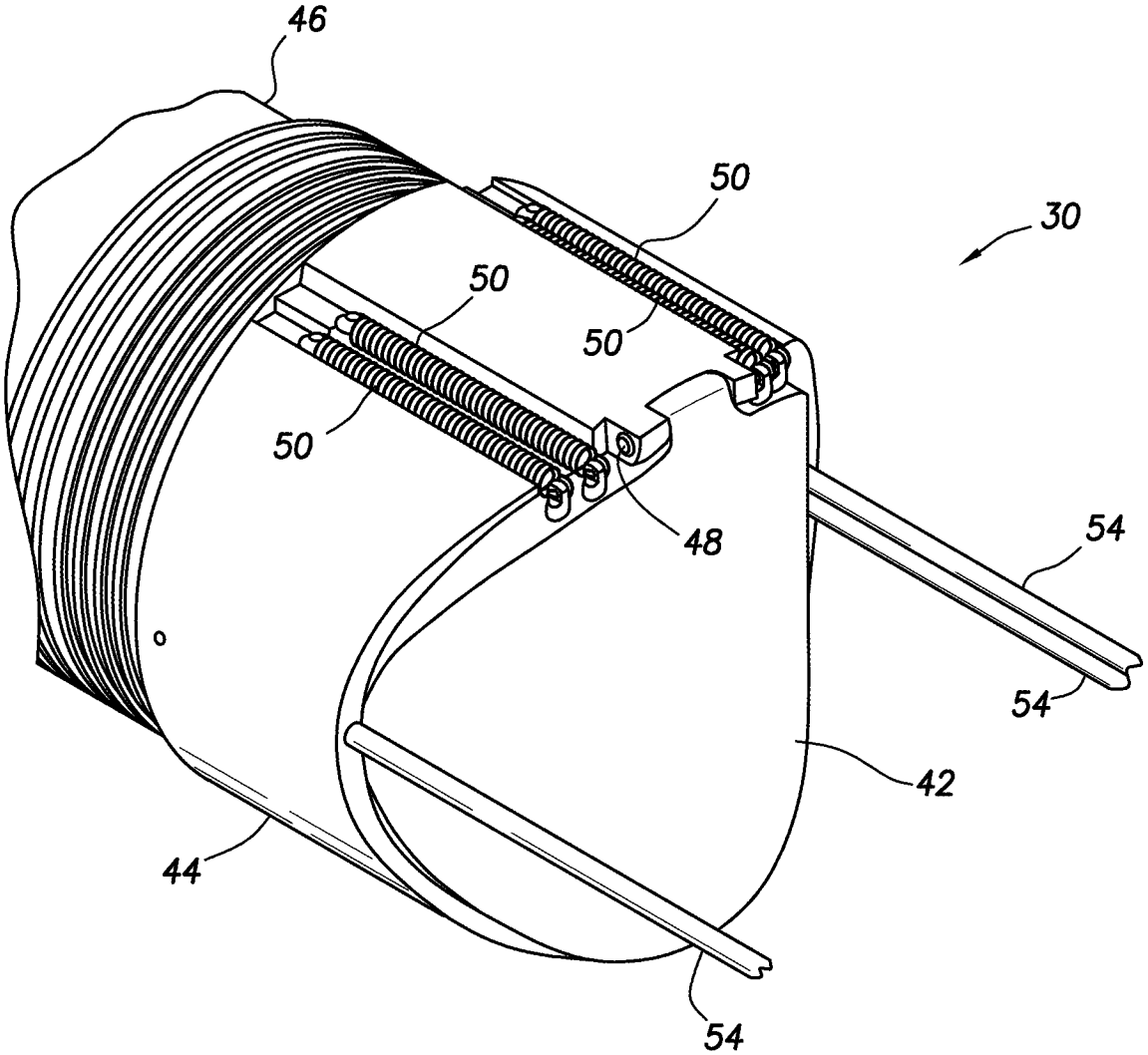
FIGS. 6 & 7 are representative isometric views of the closure member and associated components of the well tool in respective closed and open positions.
Figure 7:
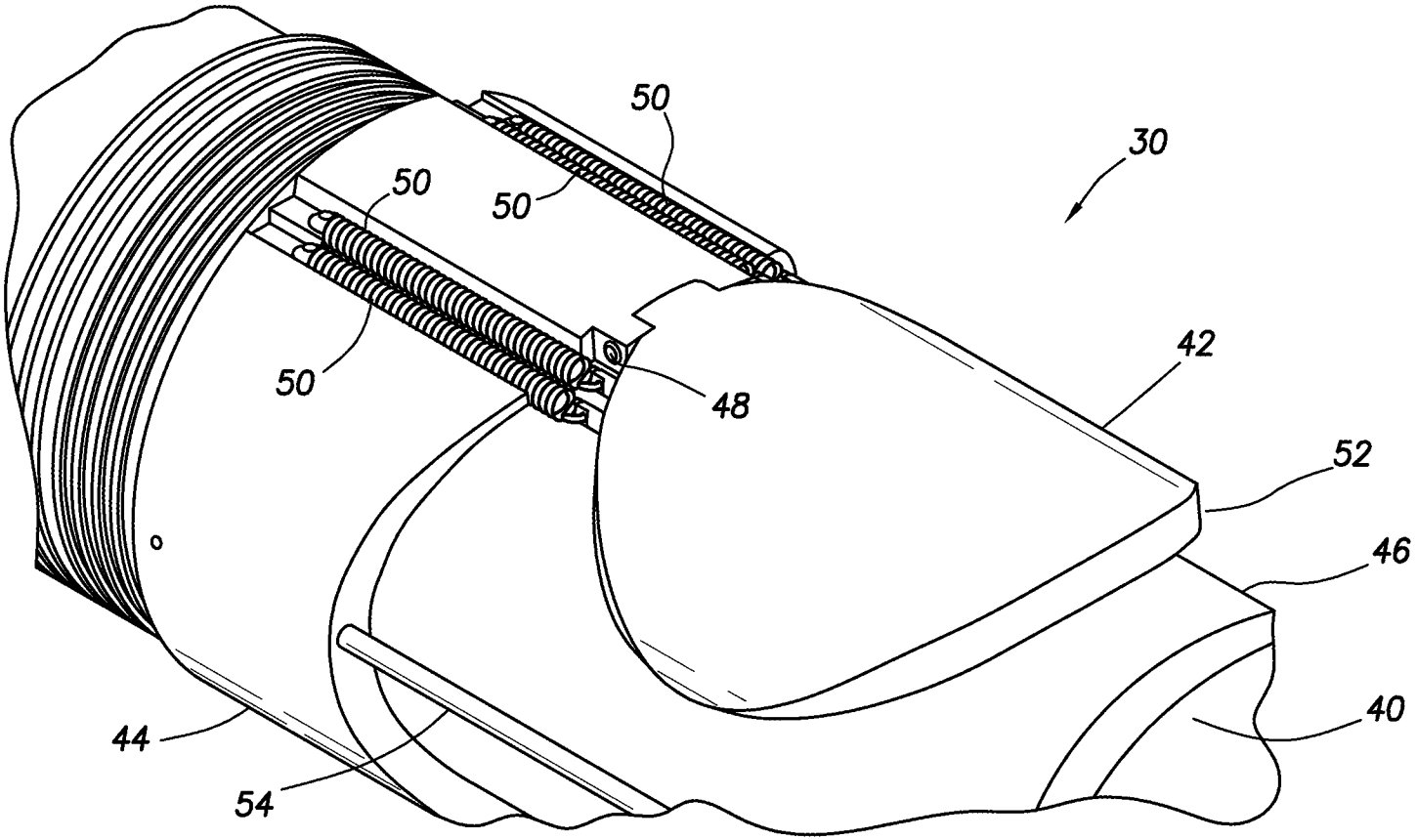

To displace the closure member 42 to its open position, the operator member 46 is displaced downward and into contact with the closure member, thereby pivoting the closure member downward about a pivot 48 against a biasing force exerted by springs 50 (not visible in FIG. 2, see FIGS. 6 & 7). The springs 50 continually bias the closure member 42 toward its closed position.

Note that it is not necessary for the closure member 42 to rotate or pivot between the open and closed positions, or for the closure member to displace in any particular direction (upward, downward, longitudinally, etc.) between the open and closed positions. Thus, the scope of this disclosure is not limited to any particular displacement of the closure member 42 between its open and closed positions.

In some examples, the operator member 46 can be displaced longitudinally to open or close the closure member 42 in response to manipulation of pressure in one or more of the lines 32. For example, pressure may be increased (e.g., using a pump connected to the surface lines 32*b*) in one of the downhole lines 32*a* to downwardly displace the operator member 46 and thereby pivot the closure member 42 downwardly to its open position, and the pressure may be decreased to upwardly displace the operator member and thereby allow the closure member to be pivoted upwardly to its closed position.

In other examples, the operator member 46 could be displaced by use of an electric motor, a linear actuator or another type of actuator or device. Components other than the operator member 46 may alternatively be used to displace the closure member 42 between its open and closed positions. Thus, the scope of this disclosure is not limited to any particular means for displacing the closure member 42 between its open and closed positions.

In the FIG. 2 example, when the closure member 42 is displaced to its open position, it is received in one side of a radially enlarged annular cavity 52. Note that one or more conduits 54 extend longitudinally in the annular cavity 52 between the seat 44 and an internal annular structure 56*a* of an outer housing 56.

The conduits 54 are positioned in the annular cavity 52, so that there is clearance between the conduits and the closure member 42 as it pivots between its open and closed positions. As described more fully below, the conduits 54 can communicate various types of signals between the seat 44 and the annular structure 56*a*, so that the downhole lines 32*a* (see FIG. 1) can extend internally through the well tool 30, without obstructing the flow passage 40, and without reducing a pressure or load capacity of the outer housing 56.

The signals may include electrical signals, in which case an electrical conductor (not shown) could extend through a conduit 54. The signals may include optical signals, in which case an optical waveguide (such as an optical fiber or optical ribbon, not shown) could extend through a conduit 54. The signals may include fluid signals (such as hydraulic or pneumatic pressure or flow variations), in which case a fluid may be transmitted through a conduit 54. Any type, number or combination of signals may be communicated using the conduits 54, in keeping with the principles of this disclosure.

Note that a passageway 58*a* extends to the seat 44 in the well tool 30, and passageway 60*a* extends to the annular structure 56*a*. The conduits 54 provide for connecting these passageways 58*a*, 60*a* (and additional passageways), as described more fully below.

Figure 3:
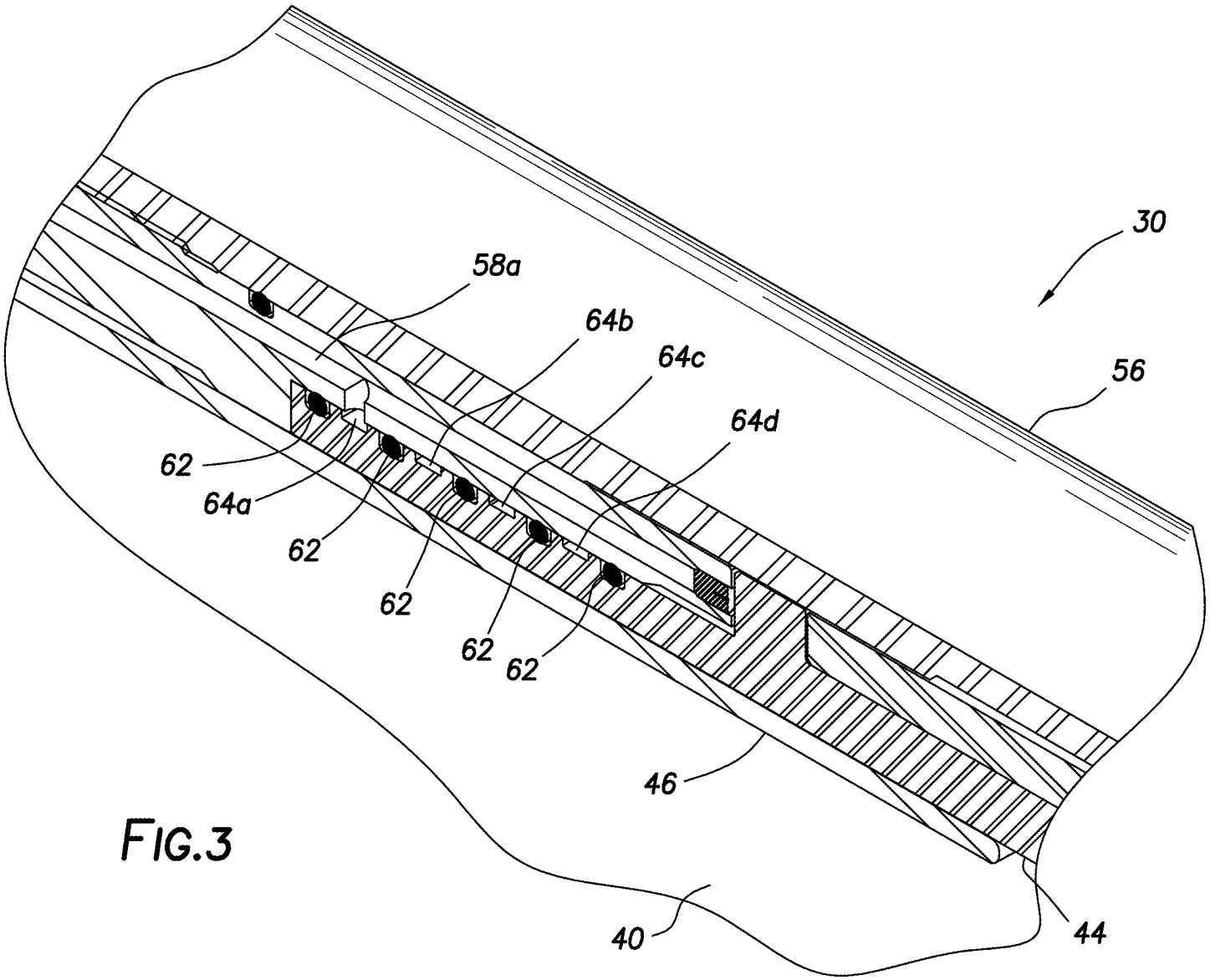
FIG. 3 is a representative isometric cross-sectional view of a routing of lines on one side of a closure member of the well tool.

Referring additionally now to FIG. 3, a representative cross-sectional view of a portion of the well tool 30 is depicted. In this view, the manner in which the passageway 58*a* communicates with the seat 44 is more clearly visible.

The seat 44 has a series of longitudinally spaced apart seals 62 on an upper end thereof, with an external annular groove 64*a-d* formed between each adjacent pair of seals. In this example, there are five of the seals 62 and four of the grooves 64*a-d*, but any number, combination or configuration may be used in other examples.

The passageway 58*a* depicted in FIG. 3 is in communication with one of the grooves 64*a*. Although not visible in FIG. 3, another passageway in the seat 44 is in communication with the annular groove 64*a*, so that the passageway in the seat is in communication with the passageway 58*a* via the annular groove 64*a*.

Figure 5:
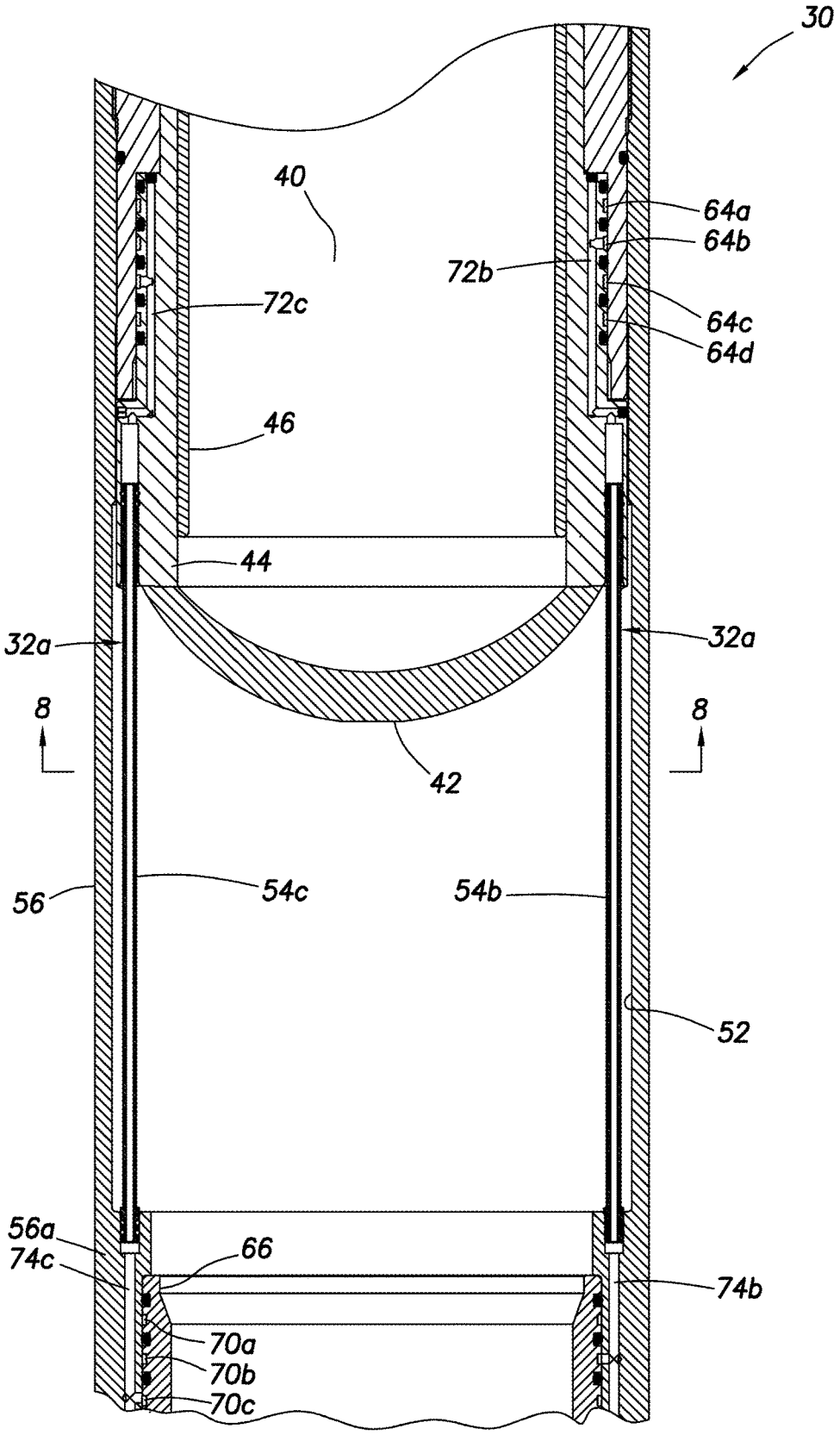
FIG. 5 is a representative cross-sectional view of a section of the well tool.

The annular groove 64*a* allows the passageway in the seat 44 to be circumferentially offset from the passageway 58*a*. Additional passageways may be in communication with respective ones of the other annular grooves 64*b-d* (as depicted in FIG. 5, for example).

Figure 4:
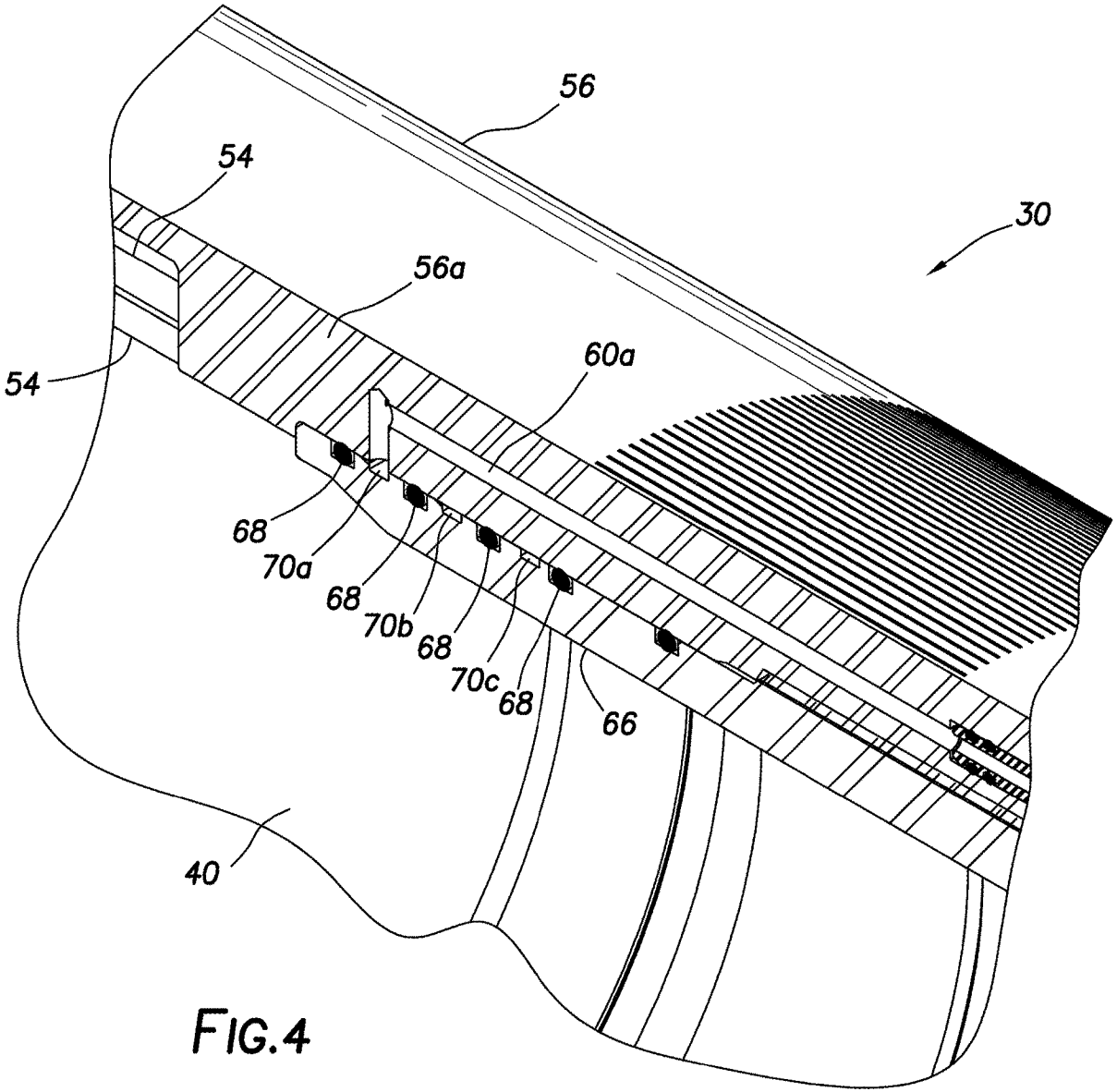
FIG. 4 is a representative isometric cross-sectional view of a routing of lines on an opposite side of the closure member.

Referring additionally now to FIG. 4, a representative cross-sectional view of another portion of the well tool 30 is depicted. In this view, the manner in which the passageway 60*a* communicates with one of the conduits 54 via an annular sleeve 66 received in the outer housing 56 is more clearly visible.

The sleeve 66 has a series of longitudinally spaced apart external seals 68 thereon, with an external annular groove 70*a-c* formed between each adjacent pair of seals. In this example, there are four of the seals 68 and three of the grooves 70*a-c*, but any number, combination or configuration may be used in other examples.

The passageway 60*a* depicted in FIG. 4 is in communication with one of the grooves 70*a*. Although not visible in FIG. 4, another passageway in the annular structure 56*a* is in communication with the annular groove 70*a*, so that the passageway in the annular structure is in communication with the passageway 60*a* via the annular groove.

The annular groove 70*a* allows the passageway in the annular structure 56*a* to be circumferentially offset from the passageway 60*a*. Additional passageways may be in communication with respective ones of the other annular grooves 70*b,c* (as depicted in FIG. 5, for example).

Referring additionally now to FIG. 5, a lateral cross-sectional view of a portion of the well tool 30 is representatively illustrated. In this example, the closure member 42 in its closed position is laterally between two of the conduits 54*b,c*.

The conduits 54*b,c* are sealingly received in the seat 44, and are sealingly received in the annular structure 56*a*. Thus, the conduits 54*b,c* provide sealed passageways for communication between the seat 44 and the annular structure 56*a*.

A passageway 72*b* formed in the seat 44 provides for communication between the annular groove 64*b* and the conduit 54*b*. Another passageway 72*c* formed in the seat 44 provides for communication between the annular groove 64*c* and the conduit 54*c*.

Passageways similar to the passageway 58*a* depicted in FIG. 3 can extend to the respective annular grooves 64*b,c*, so that communication is provided between these passageways and the respective conduits 54*b,c* via the annular grooves. In addition, other passageways in the seat 44 (not visible in FIG. 5) can be in communication with the annular grooves 64*a,d*, so that communication is provided between these passageways and other ones of the conduits 54.

A passageway 74*b* formed in the annular structure 56*a* provides for communication between the annular groove 70*b* and the conduit 54*b*. Another passageway 74*c* formed in the annular structure 56*a* provides for communication between the annular groove 70*c* and the conduit 54*c*.

Passageways similar to the passageway 60*a* depicted in FIG. 4 can extend to the respective annular grooves 70*b,c*, so that communication is provided between these passageways and the respective conduits 54*b,c* via the annular grooves. In addition, another passageway in the annular structure 56*a* (not visible in FIG. 5) can be in communication with the annular groove 70*a*, so that communication is provided between this passageway and another one of the conduits 54.

Thus, it will be appreciated that communication is provided through the well tool 30 in this example by the combination of passageways, annular grooves and conduits described above. However, it should be clearly understood that other configurations are possible in keeping with the principles of this disclosure. For example, if it is not desired to circumferentially offset passageways in the well tool 30, the annular grooves 64*a-d*, 70*a-c* may not be used.

The combination of passageways, annular grooves and conduits described above can be used to extend the downhole lines 32*a* (see FIG. 1) through the well tool 30, for example, between different portions of the well tool, between multiple different well tools, between sensors and different portions of the well tool, etc. Thus, the scope of this disclosure is not limited to any particular purpose, origin or destination for any of the lines 32*a* extended internally in the well tool 30 via the passageways, annular grooves and conduits described above.

One of the lines 32*a* can comprise a particular combination of the passageways, annular grooves and conduits described above, and another of the lines 32*a* can comprise another combination of the passageways, annular grooves and conduits. In some examples, lines 32*a* may be placed in communication with each other in the well tool 30 (such as, by providing communication between one of the grooves 64*a-d* and multiple passageways 72*b,c* in the seat 44, or by providing communication between one of the grooves 70*a-c* and multiple passageways 74*b,c* in the annular structure 56*a*).

Any number or combination of electrical conductors, optical waveguides and/or fluid can be passed through the passageways, annular grooves and conduits described above. For electrical lines and optical waveguides, less circuitous routes can be provided.

Note that it is not necessary for all of the passageways, annular grooves and conduits described above to be provided in the well tool 30. For example, only a single conduit 54 may be provided, with a passageway extending to respective ends of the conduit in the seat 44 and in the annular structure 56*a*.

Referring additionally now to FIGS. 6 & 7, the closure member 42 is representatively depicted in its respective closed and open positions, along with the seat 44, operator member 46 and conduits 54. Note that downward longitudinal displacement of the operator member 46 causes the closure member 42 to pivot downwardly to its FIG. 7 open position (thereby disposing the closure member in the annular cavity 52), and subsequent upward longitudinal displacement of the operator member allows the springs 50 to pivot the closure member upwardly to its FIG. 6 closed position.

Note, also, that the conduits 54 are not contacted by the closure member 42 as it displaces between the open and closed positions. The conduits 54 are appropriately positioned in the annular cavity 52, so that there is clearance between the conduits and the closure member 42 in all operational positions of the closure member.

Figure 8:
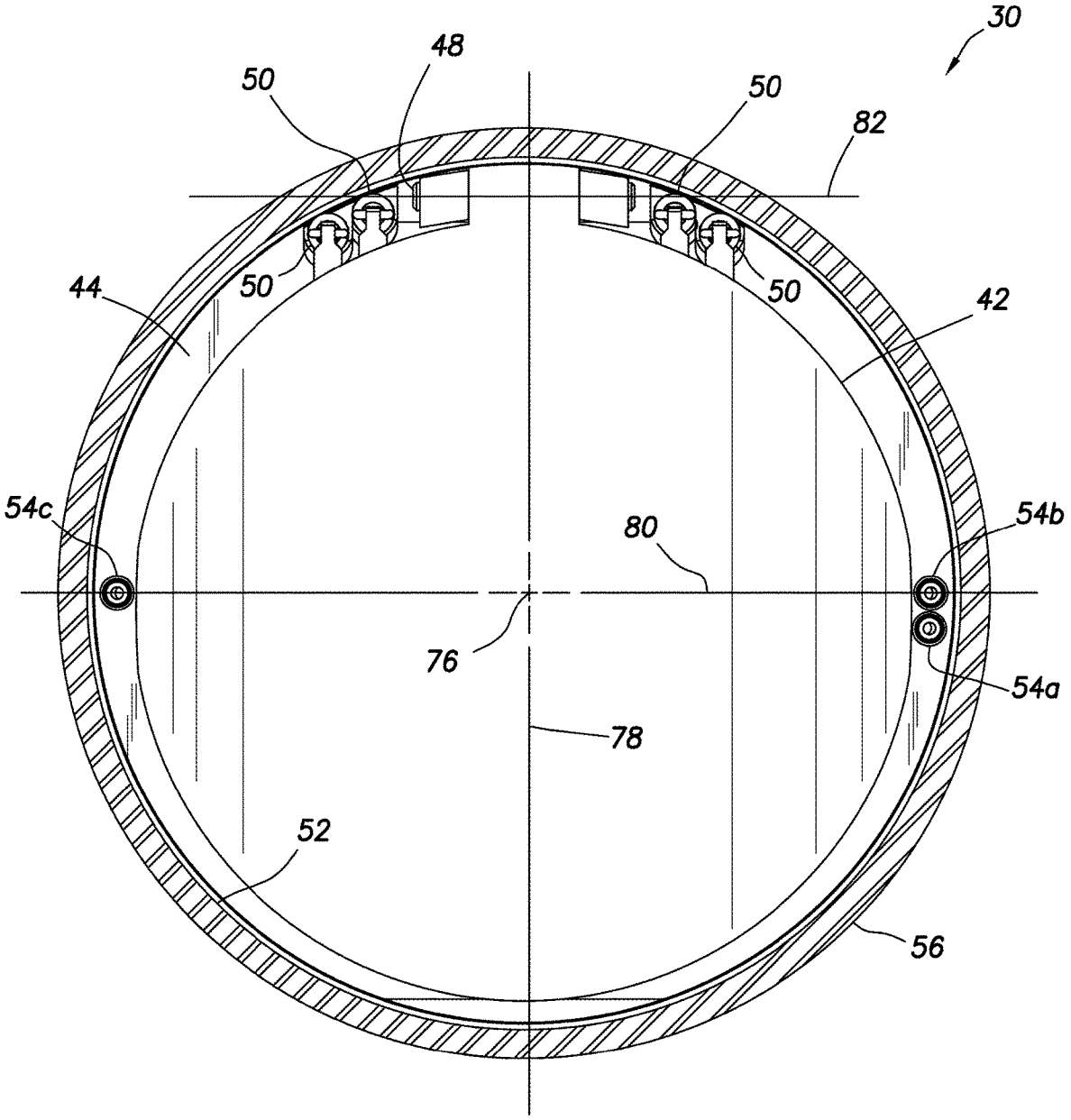
FIG. 8 is a representative cross-sectional view of the well tool, taken along line 8-8 of FIG. 5.

Referring additionally now to FIG. 8, a cross-sectional view of the well tool 30, taken along line 8-8 of FIG. 5, is representatively illustrated. In this view, the spatial relationship between the closure member 42, seat 44, annular cavity 52, conduits 54*a-c* and outer housing 56 can be clearly seen.

A center 76 of the flow passage 40 (see FIG. 5) is located at an intersection of vertical and horizontal axes 78, 80 (as viewed in FIG. 8). The vertical and horizontal axes 78, 80 are perpendicular to each other. The horizontal axis 80 is parallel to a rotational axis 82 of the pivot 48.

Note that the conduits 54*b,c* are located along the horizontal axis 80, and in the annular cavity 52. The conduit 54*a* is located "below" the axis 80 (opposite the axis from the pivot 48, as viewed in FIG. 8). The closure member 42 is shaped to provide clearance for the conduits 54*a-c*, so that the closure member does not contact the conduits as it rotates between its open and closed positions.

Preferably, but not necessarily, the conduits 54*a-c* (and any additional conduits) are located along the axis 80 or opposite the axis 80 from the pivot 48. However, the scope of this disclosure is not limited to any particular positions of conduits in the annular cavity 52.

It may now be fully appreciated that the above disclosure provides significant advances to the art of constructing and utilizing well tools with one or more lines therein. In one example described above, the lines 32*a* can be extended internally in the well tool 30, without obstructing the flow passage 40, and without reducing a pressure or load capacity of the well tool.

The above disclosure provides to the art a well tool 30. In one example, the well tool 30 can include a closure member 42 which is displaceable between open and closed positions, a seat 44 having a flow passage 40 extending therethrough which is blocked by the closure member 42 in the closed position, and at least one line 32*a* extending through the seat 44.

The line 32*a* may extend between the seat 44 and a housing 56 of the well tool 30, with the closure member 42 being positioned within the housing 56. The line 32*a* and the seat 44 may also be positioned within the housing 56.

The closure member 42 may rotate or pivot between the open and closed positions. The closure member 42 may comprise a flapper.

The line 32*a* may extend from the seat 44 into an annular cavity 52. The annular cavity 52 may outwardly surround the flow passage 40 in the open position.

The "at least one" line 32*a* may comprise multiple lines. The closure member 42 may be positioned between at least two of the lines 32*a* in the closed position.

The above disclosure also provides to the art a method of communicating through a well tool 30 in a subterranean well. In one example, the method can include positioning at least one conduit 54 in an interior of the well tool 30, and conducting a signal via the at least one conduit 54, the signal being conducted between annular structures 44, 56*a* at respective opposite ends of the conduit 54, each of the annular structures 44, 56*a* surrounding a flow passage 40 that extends longitudinally through the well tool 30.

The positioning step may include exposing the conduit 54 to the flow passage 40.

The method may include sealingly engaging a closure member 42 with one of the annular structures 44, the closure member 42 having open and closed positions, and the closure member 42 blocking flow through the flow passage 40 in the closed position. The positioning step may include positioning the conduit 54 in an annular cavity 52 of the well tool 30, and the closure member 42 being received in the annular cavity 52 in the open position.

The other annular structure 56*a* may form part of an outer housing 56 of the well tool 30.

The signal may comprise one or more of an electrical signal, a fluid signal and an optical signal.

The conducting step may include conducting the signal through at least one annular groove 64*a-d* in the annular structure 44.

The "at least one" conduit 54 may comprise multiple conduits. The positioning step may include positioning at least two of the conduits 54*b,c* on opposite lateral sides of the flow passage 40.

A well system 10 is also described above. In one example, the well system 10 can include a well tool 30 connected in a tubular string 28, a flow passage 40 of the tubular string 28 extending longitudinally through the well tool 30, the well tool 30 comprising a closure member 42 having open and closed positions, in which the closure member 42 respectively permits flow through the flow passage 40 in the well tool 30 and blocks flow through the flow passage 40 in the well tool 30, an annular cavity 52 surrounding the flow passage 40, and at least one line 32*a*, the closure member 42 and the at least one line 32*a* being positioned in the annular cavity 52 in the open position of the closure member 42.

The line 32*a* may comprise at least one conduit 54 positioned in the annular cavity 52.

The closure member 42 may sealingly engage a seat 44 in the closed position. The line 32*a* may extend through the seat 44.

The "at least one" line 32*a* may comprise multiple lines 32*a*. The closure member 42 may be positioned between at least two of the lines 32*a* in the closed position.

The well tool 30 may include an operator member 46 that displaces the closure member 42 between the open and closed positions. The operator member 46 may be disposed between the flow passage 40 and the at least one line 32*a* in the annular cavity 52 in the open position.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well tool, comprising:

a closure member which is displaceable between open and closed positions;

a seat having a flow passage extending therethrough, the flow passage being blocked by the closure member in the closed position;

a first conduit sealingly engaged with the seat, in which the first conduit is connected via an annular groove to a second conduit which is circumferentially offset from the first conduit; and a third conduit, and in which the closure member is positioned between the first and the third conduits in the closed position.

2. The well tool of claim 1, in which the first conduit extends between the seat and a housing of the well tool, the closure member being positioned within the housing.

3. The well tool of claim 2, in which the first conduit and the seat are positioned within the housing.

4. The well tool of claim 1, in which the closure member rotates between the open and closed positions.

5. The well tool of claim 4, in which the closure member comprises a flapper.

6. The well tool of claim 1, in which the first conduit extends from the seat into an annular cavity that outwardly surrounds the flow passage in the open position.

7. A method of communicating through a well tool in a subterranean well, the method comprising:

positioning first, second and third conduits in an interior of the well tool, a closure member of the well tool being positioned between the first and the third conduits in a closed position of the closure member; and conducting a signal via at least one of the first, second and third conduits, the signal being conducted between first and second annular structures at respective opposite ends of the at least one of the first, second and third conduits, each of the first and second annular structures surrounding a flow passage that extends longitudinally through the well tool.

8. The method of claim 7, in which the positioning comprises exposing the first, second and third conduits to the flow passage.

9. The method of claim 7, further comprising sealingly engaging the closure member with the first annular structure, the closure member having an open position and the closed position, the closure member blocking flow through the flow passage in the closed position.

10. The method of claim 9, in which the positioning comprises positioning the first, second and third conduits in an annular cavity of the well tool, and the closure member being received in the annular cavity in the open position.

11. The method of claim 7, in which the second annular structure is part of an outer housing of the well tool.

12. The method of claim 7, in which the signal comprises at least one of the group consisting of an electrical signal, a hydraulic signal and an optical signal.

13. The method of claim 7, in which the conducting comprises conducting the signal through at least one annular groove in the first annular structure.

14. The method of claim 7, in which the positioning comprises positioning at least two of the first, second and third conduits on opposite lateral sides of the flow passage.

15. A well system, comprising:

a well tool connected in a tubular string, a flow passage of the tubular string extending longitudinally through the well tool, the well tool comprising an annular cavity surrounding the flow passage, first, second and third conduits in an interior of the well tool, and a closure member having open and closed positions, in which the closure member respectively permits flow through the flow passage in the well tool and blocks flow through the flow passage in the well tool, the closure member being positioned between the first and the third conduits in the closed position of the closure member, and the closure member and the first, second and third conduits being positioned in the annular cavity in the open position of the closure member.

16. The well system of claim 15, in which the first, second and third conduits are positioned in the annular cavity in the closed position.

17. The well system of claim 15, in which the closure member sealingly engages a seat in the closed position, and in which the first, second and third conduits are sealingly engaged with the seat.

18. The well system of claim 15, in which the well tool further comprises an operator member that displaces the closure member between the open and closed positions, and in which the operator member is disposed between the flow passage and the first, second and third conduits in the annular cavity in the open position.

* * * * *